US008137130B2

(12) United States Patent
Wang

(10) Patent No.: US 8,137,130 B2
(45) Date of Patent: Mar. 20, 2012

(54) FOLDABLE PATCH PANEL

(75) Inventor: Chu-Li Wang, Taipei (TW)

(73) Assignee: EMCOM Technology Inc., Taipei (TW)

( * ) Notice: Subject to any disclaimer, the term of this patent is extended or adjusted under 35 U.S.C. 154(b) by 0 days.

(21) Appl. No.: 12/961,483

(22) Filed: Dec. 6, 2010

(65) Prior Publication Data

US 2011/0159726 A1 Jun. 30, 2011

(30) Foreign Application Priority Data

Dec. 31, 2009 (TW) ..... 98146570 A

(51) Int. Cl.
*H01R 13/60* (2006.01)

(52) U.S. Cl. ..... 439/540.1

(58) Field of Classification Search ..... 439/540.1, 439/713, 719; 361/825; 385/134
See application file for complete search history.

(56) References Cited

U.S. PATENT DOCUMENTS

| | | | | |
|---|---|---|---|---|
| 4,116,514 | A * | 9/1978 | Lawrence | 439/31 |
| 6,083,010 | A * | 7/2000 | Daoud | 439/31 |
| 6,537,106 | B1 * | 3/2003 | Follingstad | 439/534 |
| 6,918,786 | B2 | 7/2005 | Barker et al. | |
| 6,971,909 | B2 | 12/2005 | Levesque et al. | |
| 6,981,893 | B2 | 1/2006 | Barker et al. | |
| 7,094,095 | B1 | 8/2006 | Caveney | |
| 2005/0142932 | A1 * | 6/2005 | Levesque et al. | 439/540.1 |
| 2008/0176445 | A1 * | 7/2008 | Shifris et al. | 439/540.1 |
| 2009/0305554 | A1 * | 12/2009 | Siano | 439/540.1 |

* cited by examiner

*Primary Examiner* — Tulsidas C Patel
*Assistant Examiner* — Harshad Patel
(74) *Attorney, Agent, or Firm* — Cheng-Ju Chiang

(57) ABSTRACT

The present invention provides a foldable patch panel. The foldable patch panel includes a first frame, a second frame, and a pivot unit. The pivot unit is connected to the first frame and the second frame, respectively, so that spinning center of the first frame and the second frame is the pivot unit. Besides, the first frame and the second frame are separably engaged with each other and form an obtuse angle.

15 Claims, 14 Drawing Sheets

FOLDABLE PATCH PANEL

BACKGROUND OF THE INVENTION

1. Field of the Invention

The invention generally relates to a patch panel; particularly, the invention relates to a foldable patch panel.

2. Description of the Prior Art

U.S. Pat. No. 6,971,909 discloses an angled patch panel with improved flange which is connected to a rack. However, though the distance between the patch panel element and the flange is extended, the patch panel elements can not be folded to minimize the dimension of the angled patch panel.

U.S. Pat. No. 7,094,095 discloses an angled patch panel with a frame including a first panel section and a second section. The first and second panel sections are connected and angled by means of a centerpiece. Since the centerpiece is lack of foldable design, the first and second panel sections are not foldable to minimize the dimension of the angled patch panel.

Furthermore, U.S. Pat. No. 6,918,786 discloses a patch panel with an outwardly angled central frame, wherein the central frame has a plurality of openings, and a flat centerpiece is located midway along the frame to space the openings on opposite halves of the central frame. Though the flat centerpiece can reduce the depth of the patch panel and in turn reduce the outward angle of the central frame, the outwardly angled central frame cannot be folded to minimize the dimension of the angled patch panel.

U.S. Pat. No. 6,981,893 discloses a patch panel with an outwardly angled frame in an inverted V-shape. Although the inverted V-shape frame provides additional space behind the panel patch to accommodate the cabling needs, the inverted V-shape frame is still not foldable to provide flexible configurations for different needs.

Therefore, an inventive foldable patch panel is provided to achieve different configurations.

SUMMARY OF THE INVENTION

One object of the present invention is to provide a foldable patch panel, wherein the free ends of a first frame and a second frame are closed to each other by folding the patch panel to reduce the distance between the free ends of the patch panel.

Another object of the present invention is to provide a foldable patch panel, wherein by folding the first frame and the second frame of the foldable patch panel together, the dimension of the foldable patch panel can be reduced to increase transportation convenience.

The foldable patch panel includes a first frame, a pivot unit, and a second frame. The first frame and the second frame are connected to the pivot unit, so that the first frame and the second frame are rotatable with respect to each other and separably engaged with each other. The first frame and the second frame form an obtuse angle when they are engaged with each other in an open configuration. The first frame and the second frame are parallel to each other when they are folded together in a folded configuration.

DETAILED DESCRIPTION OF THE PREFERRED EMBODIMENT

Figure 1A:
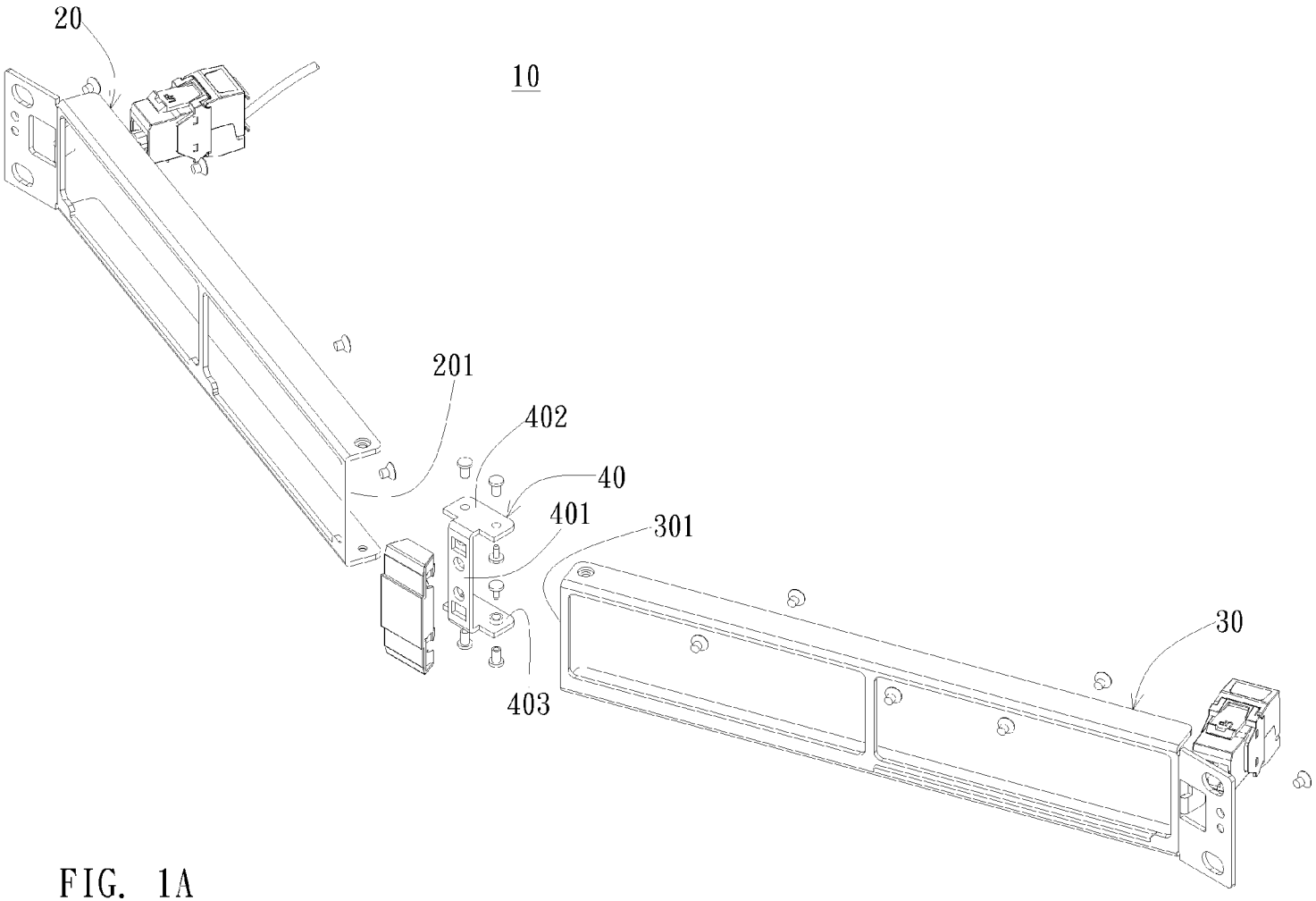
FIG. 1A is an exploded view of the foldable patch panel of the present invention.
Figure 1B:
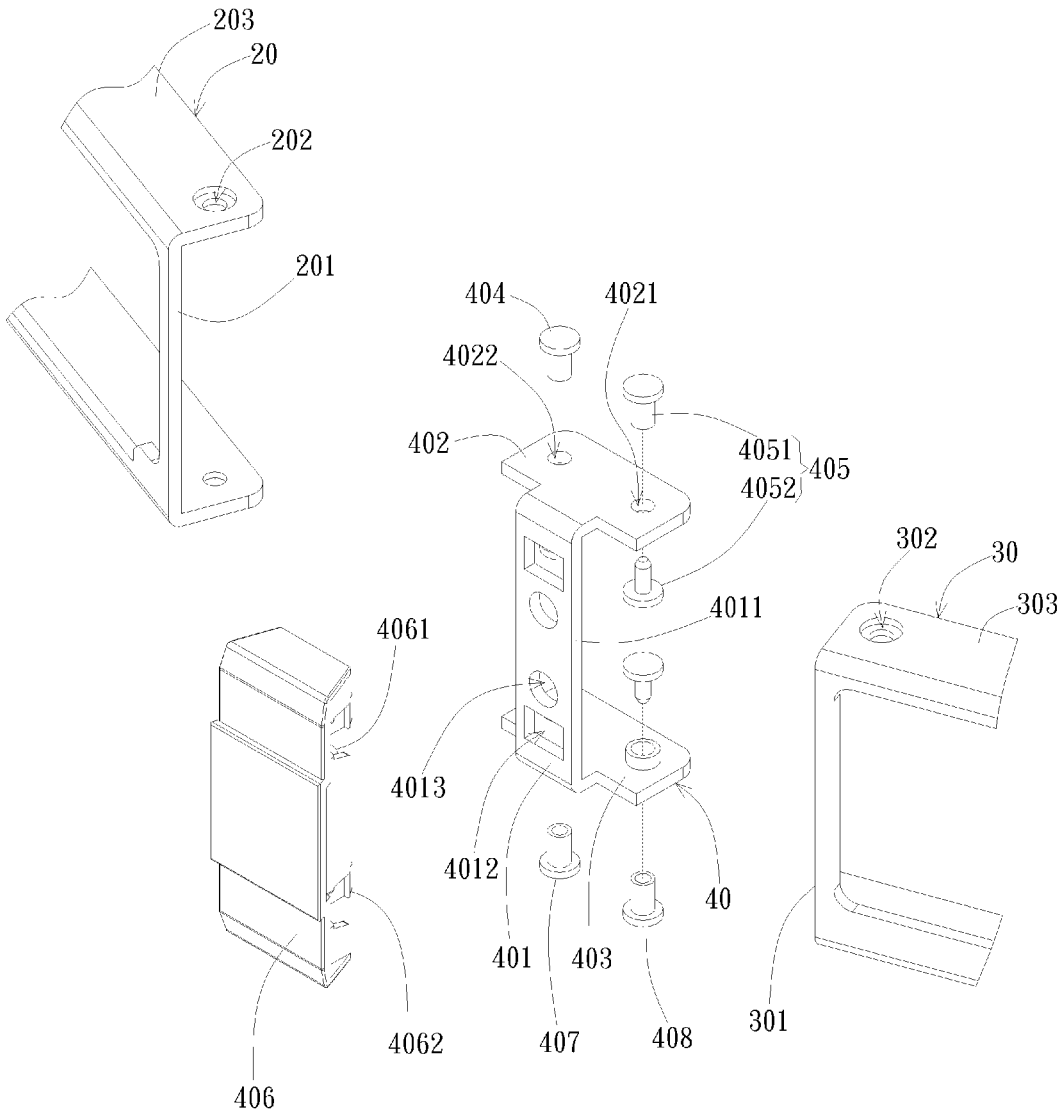
FIG. 1B is an exploded view of an embodiment of the connection unit of the present invention.

As shown in FIG. 1A, in one embodiment, the foldable patch panel 10 includes a first frame 20, a second frame 30, and a connection unit 40. The connection unit 40 includes a stopper 401 and at least one connection ear. In the present embodiment, the connection unit 40 includes an upper connection ear 402 and a lower connection ear 403. The upper connection ear 402 and the lower connection ear 403 are coupled with two opposite ends of the stopper 401, respectively. The method of coupling the connection ear 402, 403 and the stopper 401 can include, but not limited to, soldering, hinging, screwing, adhering, injection-molding, or casting. As shown in FIG. 1B, the stopper 401 is preferably in form of a plate and includes stopper edges 4011 on its two sides, so that an engaging end 201 of the first frame 20 and an engaging end 301 of the second frame 30 can be separably engaged with the stopper edges 4011, respectively. In the embodiment, the term "be separably engaged" will be described in detail later. The connection unit 40 is preferably made of metal, especially lightweight alloys such as stainless steel or aluminum alloys. Hence, the connection unit 40 can sustain friction or impact induced by the engagement with the engaging end 201, 301. In the other embodiments, however, the connection unit 40 can be made of plastic materials such as plastics or reinforced plastics with sufficient anti-impact strength to further reduce the weight of the connection unit 40 and to avoid the deformation of the foldable patch panel 10 during long-term use.

In the embodiment shown in FIG. 1B, the connection unit 40 includes a first pivot 404 and a second pivot 405 which are connected to the first frame 20 and the second frame 30, respectively. As shown in FIG. 1B, the mechanical structure and connecting method for the first pivot 404 and the second pivot 405 are preferably the same. In other embodiments (not shown), however, the mechanical structure and connecting method for the first pivot 404 and the second pivot 405 can be different to connect the frames 20, 30 and the connection unit 40. In this embodiment, the upper connection ear 402 has connection holes 4021, 4022 on two ends. The upper connection ear 402 is rotatably connected to first frame 20 and the second frame 30 by means of the first and second pivots 404, 405 through the connection holes 4022, 4021. As shown in FIG. 1B, the connecting relationship between the connection unit 40 and the first frame 20/the second frame 30 is described by using the second pivot 405 as an example. Specifically, the second pivot 405 includes a sleeve nut 4051 and a bolt 4052. When the connection hole 4021 of the upper connection ear 402 are axially aligned with the connection hole 302 of the second frame 30, the bolt 4052 is inserted into the connection holes 4021 and 302 and received in the sleeve nut 4051 so that the second frame 30 is rotatably connected to the connection ear 402. The connection between the upper connection ear 402 and the first frame 20 can be achieved through the first pivot 404 and the connection holes 4022 and 202 in a similar manner as described above. In other embodiments (not shown), however, the connection ear and the frame can be rotatably connected by other mechanisms, such as rivet or bearing to achieve the effect similar to the sleeve nut 4051 and the bolt 4052. In this embodiment, the upper connection ear 402 includes the connection holes 4021 and 4022 respectively axially corresponding to the connection holes 302 and 202 on the engaging ends 301 and 201 to allow the second pivot 405 and the first pivot 404 to be provided between the connection unit 40 and the second frame 30 and between the connection unit 40 and the first frame 20. Preferably, the lower connection ear 403, the first frame 20, and the second frame 30 have similar features so that the third pivot 407 and the fourth pivot 408 are respectively provided between the lower connection ear 403 and the first frame 20 and between the lower connection ear 403 and the second frame 30, so that the first frame 20 and the second frame 30 are rotatably connected to the lower connection ear 403. In other embodiments (not shown), however, the lower connection ear 403 is not necessary to be rotatably connected to the first frame 20 and the second frame 30. That is, the lower connection ear 403 may not include any connection hole.

Figure 1C:
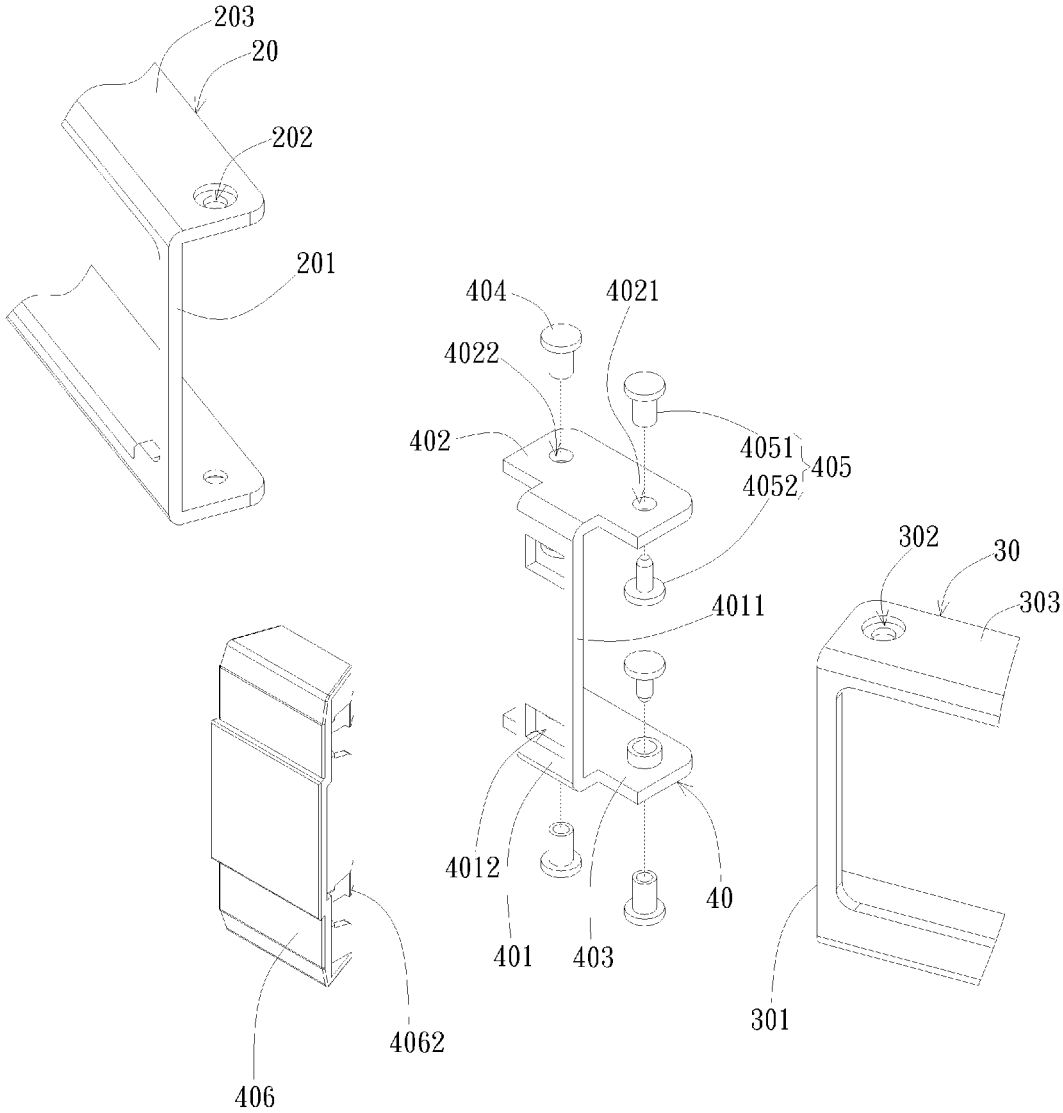
FIG. 1C is a schematic view of the stopper.

In the embodiment shown in FIG. 1B, the connection unit 40 further has a protective cover 406 for protecting the stopper 401 from damage caused by direct impact. Therefore, the protective cover 406 is preferably made of shock-absorbing material, such as plastics. Besides, the protective cover 406 can provide available marking area for identification or desirable information. In the embodiment, the stopper 401 further has an engaging hole 4012 and a fastening hole 4013. The shape of the fastening hole 4013 is preferably a circle; in other embodiments, however, the shape of the fastening hole 4013 can be any suitable geometric shape, such as triangle, rhombus, rectangle, oval, or polygon. The protective cover 406 has a fixing bolt 4061 and a hook 4062 respectively engaged with the fastening hole 4013 and the engaging hole 4012, so that the protective cover 406 can be attached to the stopper 401. In other embodiments, however, as shown in FIG. 1C, only the hook 4062 and the engaging hole 4012 are respectively disposed on the protective cover 406 and the stopper 401 to achieve the effect of attaching the protective cover 406 to the stopper 401 by engaging the hook 4062 with the engaging hole 4012. In different embodiments (not shown), only the fixing bolt 4061 and the fastening hole 4013 are respectively deposed on the protective cover 406 and the stopper 401 to achieve the effect of fixing the protective cover 406 onto the stopper 401.

Figure 1D:
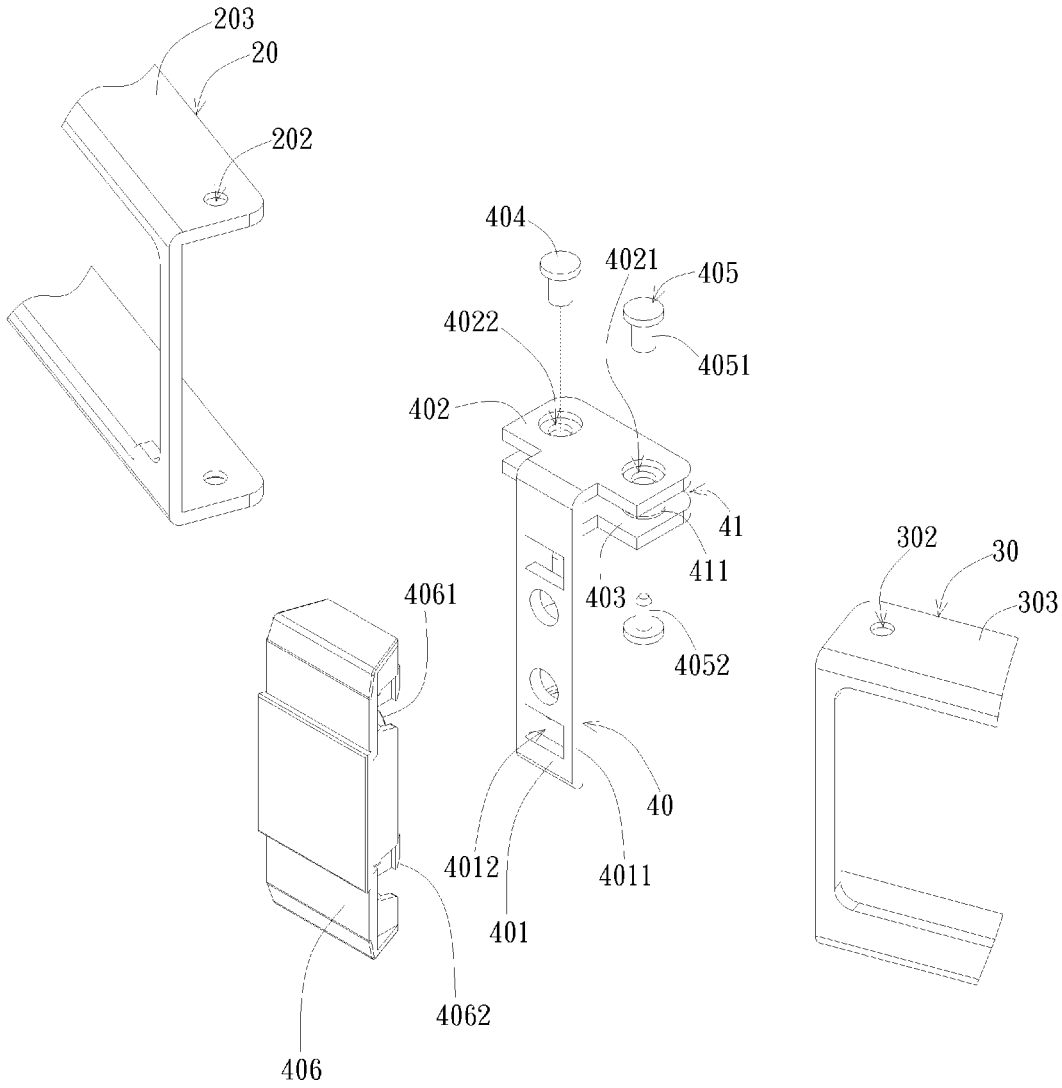
FIG. 1D is a schematic view of another embodiment of the connection unit.

In a variant embodiment shown in FIG. 1D, the connection ears are not necessary to be connected to two opposite ends of the stopper 401. For example, in this embodiment, the lower connection ear 403 is disposed close to the upper connection ear 402, instead of the lower end of the stopper 401, to form a receiving space 41 with the upper connection ear 402. The receiving space 41 can accommodate the upper plate 203 of the first frame 20 and the upper plate 303 of the second frame 30. In the embodiment, the structures of the connection holes 202, 302 of the frames 20, 30 and the connection holes 4022, 4021 of the upper connection ear 402 are accordingly modified to fit the pivots 404, 405. Since the receiving space 41 is configured to properly accommodate the upper plates 203, 303, the thickness of the receiving space 41 (i.e. the distance between the upper and lower connection ears 402 and 403) is preferably larger than the thickness of the upper plates 203, 303. As such, a proper space is reserved for the rotatable connection of the connection unit 40 and the first frame 20/the second frame 30, and the hindrance of the foldable feature of the patch panel 10 can be prevented. In other embodiments (not shown), however, the thickness of the receiving space 41 can be substantially the same as the upper plates 203, 303. Further more, gaskets 411 can be disposed between the first frame 20/the second frame 30 and the upper connection ear 402/the lower connection ear 403 in the receiving space 41 to enhance the relative rotatable connection of the connection unit 40 with the first frame 20 and the second frame 30. In addition to the above function, the gasket 411 can also adjust the distance between the upper connection ear 402 and the lower connection ear 403 to prevent the looseness of the first frame 20 and the second frame 30 from the connection unit 40. Moreover, in other embodiments (not shown), the upper connection ear 402 and the lower connection ear 403 can be disposed on other suitable position of the stopper 401 to be rotatably connected to the first frame 20 and the second frame 30, for example, the middle of the stopper 401.

Figure 2A:
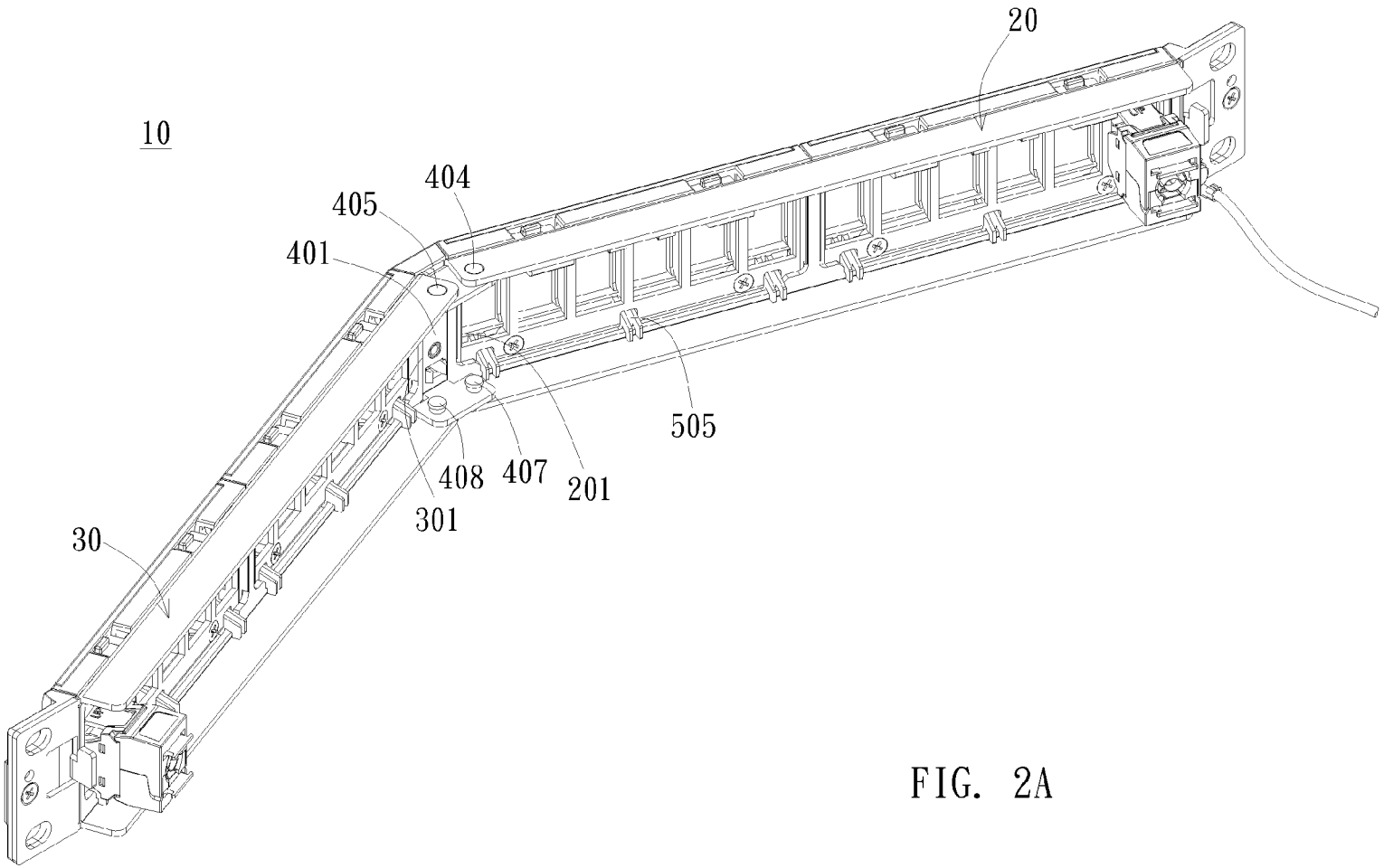
FIG. 2A is a rear view of the foldable patch panel.
Figure 2B:
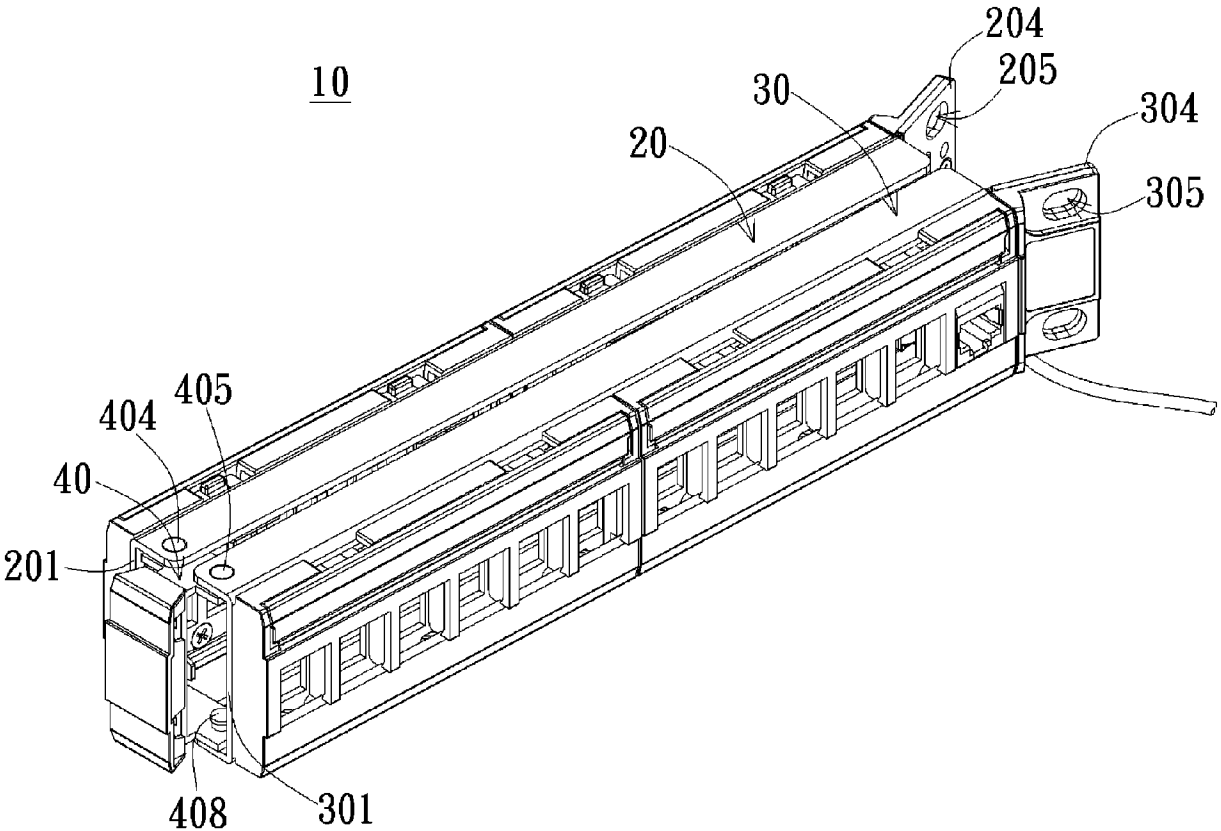
FIG. 2B is a schematic view of the foldable patch panel in a folded configuration.

In the embodiment shown in FIG. 2A and FIG. 2B, the first frame 20 and the second frame 30 rotate with respect to the first pivot 404, the second pivot 405, the third pivot 407, and the fourth pivot 408. During the rotation, the engaging ends 201, 301 of the first frame 20 and the second frame 30 are separably engaged with the stopper sides 4011 of the stopper 401 to form an open configuration. In such an open configuration, the first frame 20 and the second frame 30 form an obtuse angle, so that an angled patch panel 10 is formed, as shown in the FIG. 2A. Alternatively, with the rotatable feature, the first frame 20 and the second frame 30 can rotate with respect to the connection unit 40 to form a folded configuration, so that the first frame 20 and the second frame 30 are folded to be parallel to each other, as shown in FIG. 2B. As shown in FIG. 1B, the term "be separably engaged" used between the first frame 20/the second frame 30 and the connection unit 40 is similar. Therefore, only the separably engagement between the second frame 30 and the connection unit 40 is described as an example. For example, the term "be separably engaged" used herein means that the engaging end 301 can be selectively engaged with the stopper side 4011 and move away from the stopper side 4011 in response to the relative rotation of the engaging end 301 and the stopper side 4011 through the second pivot 405. In other embodiments (not shown), it is feasible to dispose only one of the first pivot 404 and the second pivot 405 to achieve the above open/folded configuration and fulfill the foldable function the foldable patch panel 10. That is, one of the first frame 20 and the second frame 30 is rotatable and the relative rotation is sufficient to achieve the open/folded configuration. In the embodiment shown in FIG. 2A, when the engaging ends 201, 301 of the first frame 20 and the second frame 30 are respectively in contact with the stopper sides 4011 of the stopper 401, the range of the obtuse angle is preferably 90°~180°, more preferably 120°~160°, 110°~140°, or 130°~145°.

In the embodiment shown in FIG. 2B, the first frame 20 and the second frame 30 include the engaging ends 201, 301 and the connection ends 204, 304, wherein the engaging ends 201, 301 and the connection ends 204, 304 are preferably two opposite ends of the first frame 20 and the second frame 30, respectively. In other embodiments, however, the engaging ends 201, 301 and the connection ends 204, 304 can be disposed according to different design requirements. In the embodiment, each of the connection ends 204, 304 has at least one mounting hole 205, 305. The mounting holes 205, 305 are provided for mounting the foldable patch panel 10 on a rack. The mounting method herein preferably includes, but not limited to, screwing, soldering, hinging, using rivet, or stacking.

Figure 3A:
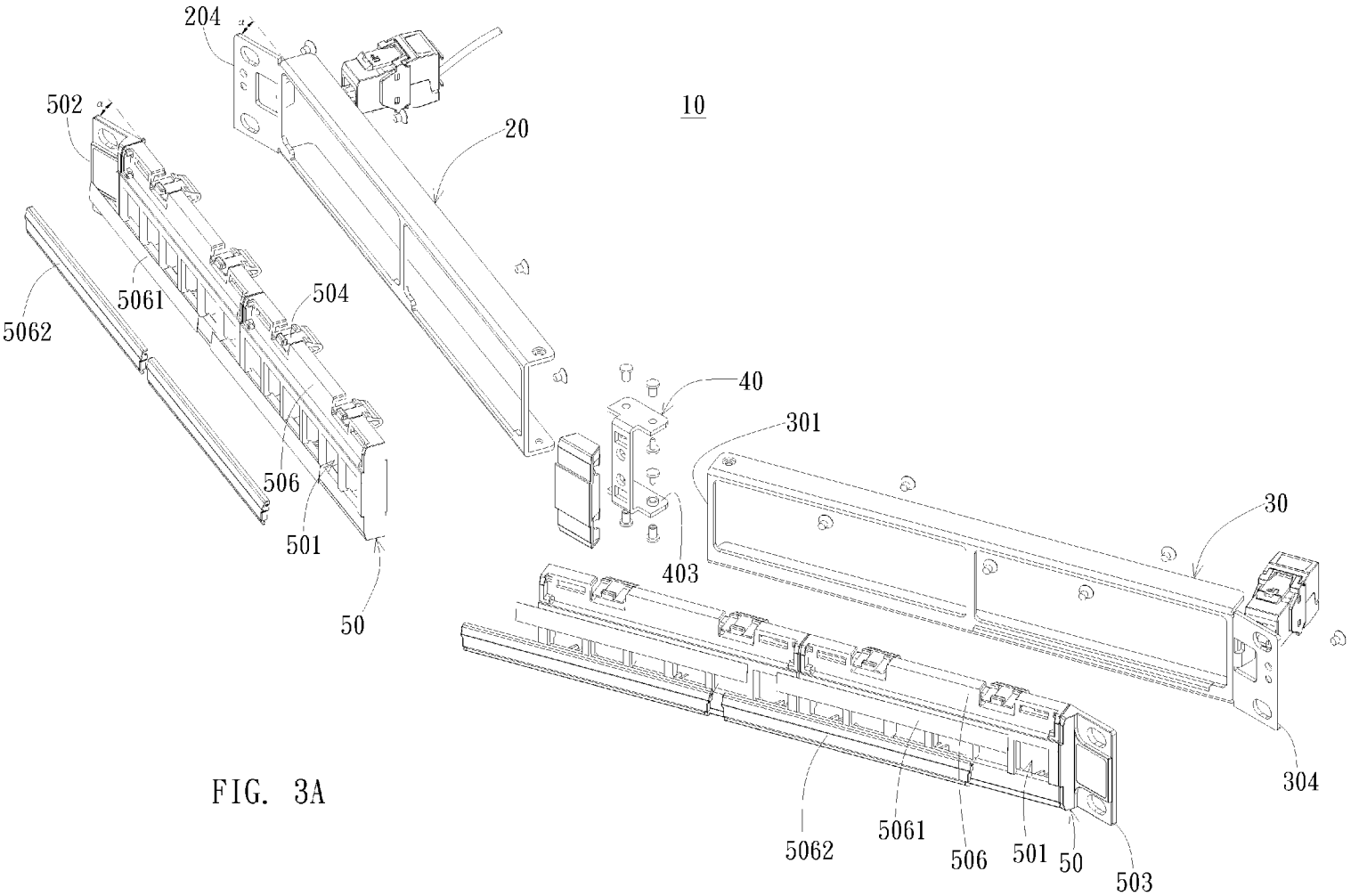
FIG. 3A is an exploded view of the casing of the foldable patch panel.

In the embodiment shown in FIG. 3A, the foldable patch panel 10 further includes a casing 50. The casing 50 can be engaged with the first frame 20 and the second frame 30, respectively. The casing 50 is preferably made of impact absorbing materials, such as plastics or reinforced plastics. In other embodiments, however, the casing 50 can be made of metal, such as lightweight alloys including stainless steel or aluminum alloys. As shown in FIG. 3A, the casing 50 includes at least one cable connection hole 501 for allowing the cable to pass therethrough to connect a connector. In the embodiment, the casing 50 further includes protective casings 502, 503 corresponding to the connection ends 204, 304 of the first frame 20 and the second frame 30. The protective casings 502, 503 protect the connection ends 204, 304 from damage or break caused by direct impact, and therefore the protective casings 502, 503 are preferably made of shock absorbing materials, such as plastics. In the embodiment, the protective casings 502, 503 are not directly connected to the casing 50 but fixed on the connection ends 204, 304 by screws. In other embodiments, however, the protective casings 502, 503 and the casing 50 can be integrally formed as one piece. Since the first frame 20 and the second frame 30 generally form an obtuse angle, the connection end 204, 304 and the respective frame 20, 30 are designed to have a specific angle $\alpha$ to smoothly fixing the connection ends 204, 304 of the foldable patch panel 10 on the rack. Hence the protective casings 502, 503 also form a corresponding sloping angle $\alpha$ with the casing 50. In other embodiments (not shown), however, the connection ends 204, 304 can be designed to have certain flexibility to fit the rack by different angle.

Figure 3B:
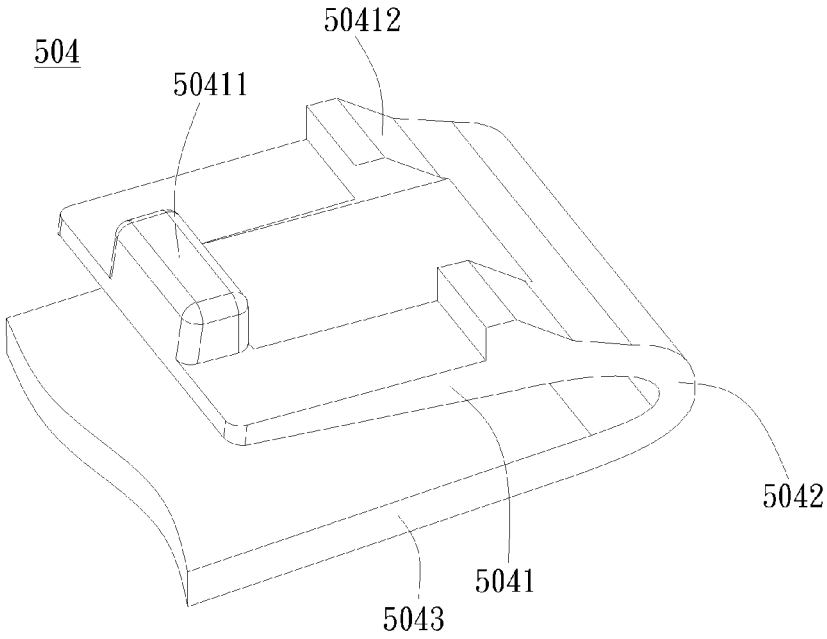
FIG. 3B is a schematic view of an embodiment of the upper hook.
Figure 3C:
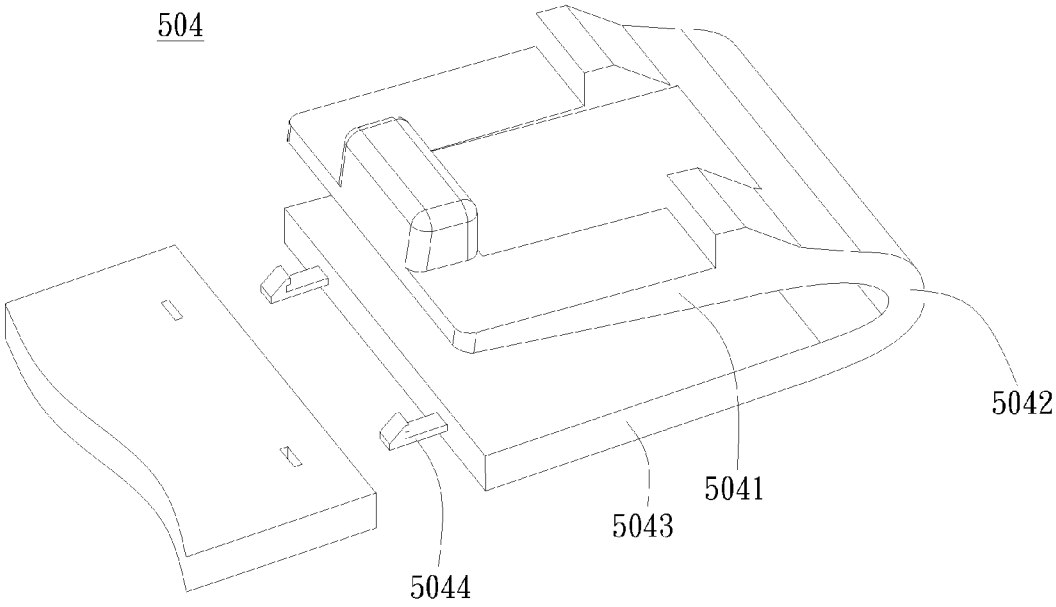
FIG. 3C is a schematic view of another embodiment of the upper hook.

In the embodiment shown in FIG. 3A and FIG. 2A, the casing 50 includes at least one upper hook 504 and at least one lower hook 505, wherein the upper hook 504 preferably has flexibility, and the lower hook 505 is more rigid to engage with the lower portion of the first frame 20. Because the upper hook 504 has flexibility, the upper hook 504 can be flexibly engaged with the upper plate 203 of the first frame 20 after the lower hook 505 is engaged, so that the casing 50 can be engaged with the first frame 20. In other embodiments, however, the flexibility/rigidity of the upper hook 504 and the lower hook 505 can be interchanged to reach the same effect. As shown in FIG. 3B, the upper hook 504 includes a pressing portion 5041, a connection portion 5043, and a U-shape connection member 5042 connected between the pressing portion 5041 and the connection portion 5043. The connection portion 5043 is connected to the casing 50. In the embodiment, the upper hook 504 and the casing 50 are preferably integrally formed. In other embodiments, however, as shown in FIG. 3C, the upper hook 504 can be fixed onto the casing 50 by suitable engaging mechanism, such as hook 5044. As shown in FIG. 3B, the pressing portion 5041 includes a pressing spot 50411 and an engaging spot 50412. For example, the pressing spot 50411 or the engaging spot 50412 can be a protruding portion on the surface of the pressing portion 5041. As the user presses down the pressing spot 50411, the engaging spot 50412 correspondingly vertically goes down to be engaged with the first frame 20 or the second frame 30.

In the embodiment shown in FIG. 3A, the casing 50 further includes an indication region 506, wherein the user can dispose an indication label 5061 on the indicating region 506. For avoiding the indication label 5061 to be smeared, a transparent cover 5062 is provided on the casing 50 and protects the indication region 506. The transparent cover 5062 is preferably coated with lipophilic molecules. Optionally, the transparent cover 5062 can be coated with hydrophilic molecules for specific use.

Figure 4A:
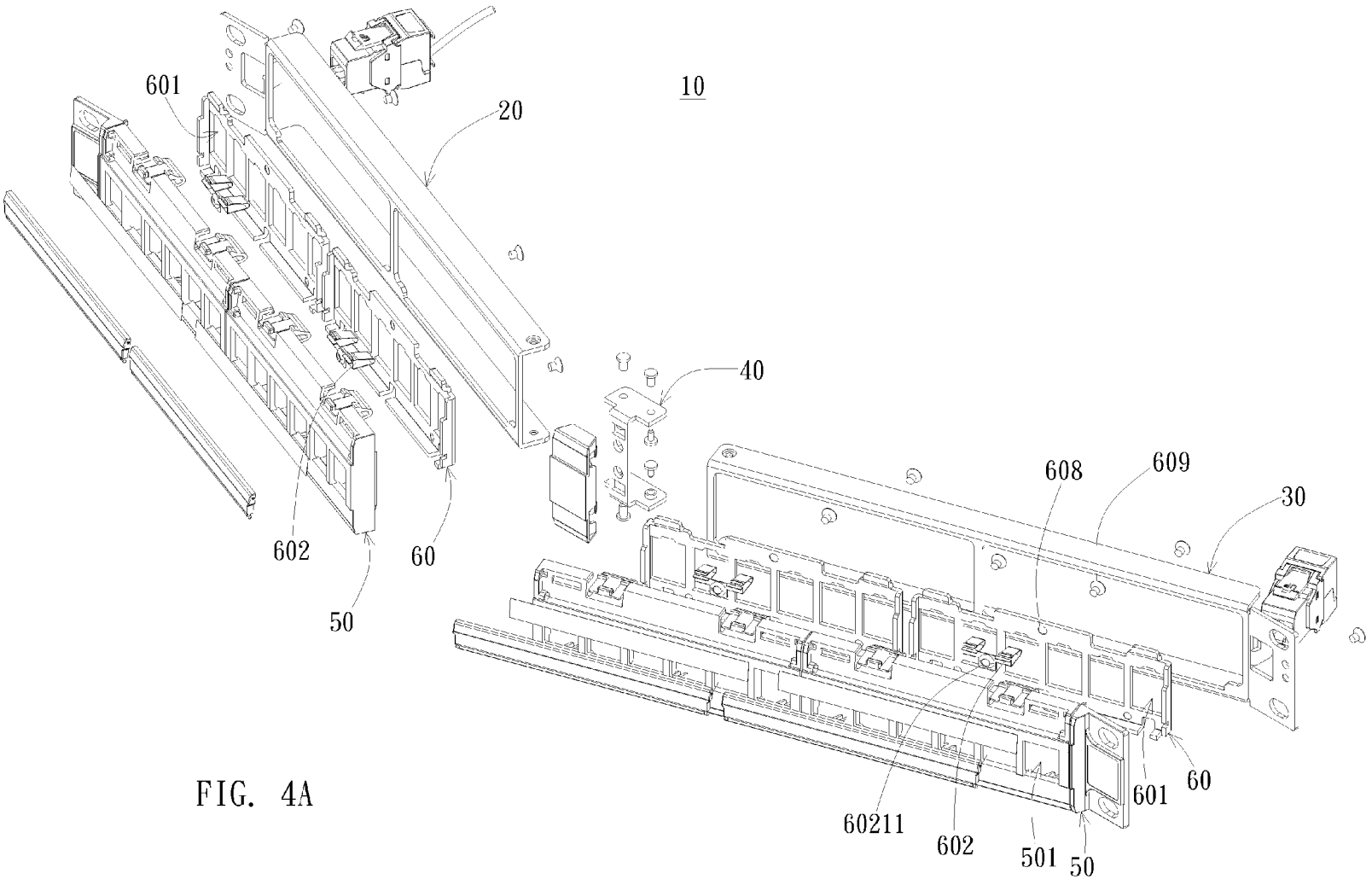
FIG. 4A is an exploded view of the auxiliary frame of the foldable patch panel.
Figure 4B:
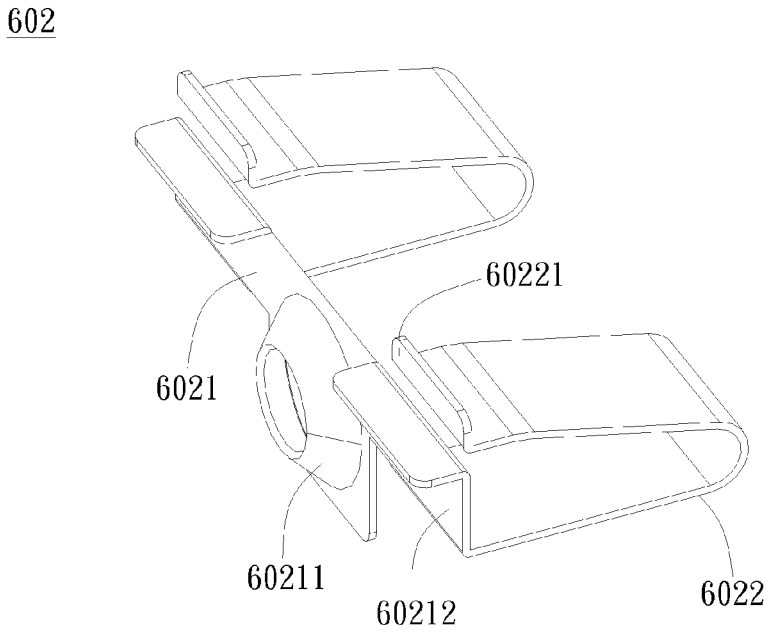
FIG. 4B is a schematic view of an embodiment of the spring unit.
Figure 4C:
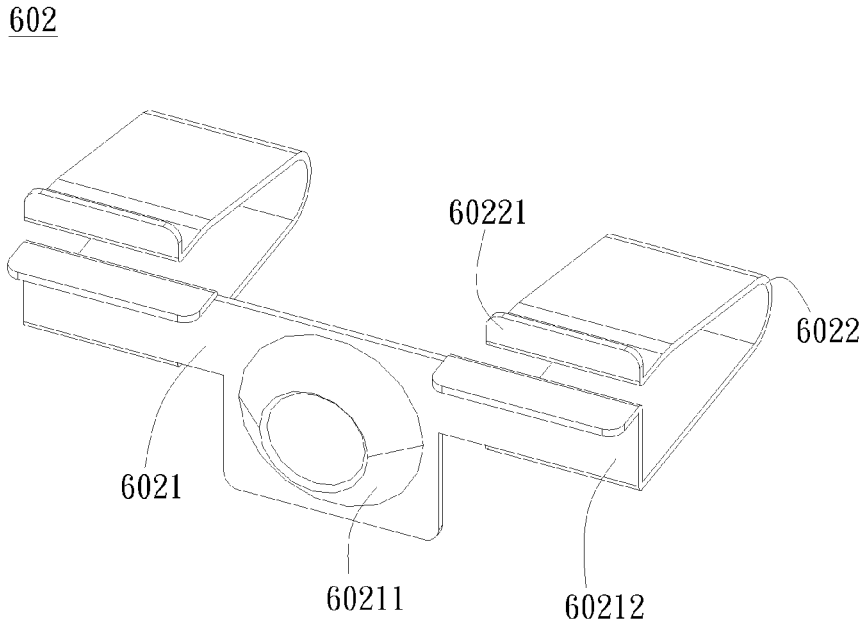
FIG. 4C is another schematic view of the spring unit.

In the embodiment shown in FIG. 4A, the foldable patch panel 10 further includes at least one auxiliary frame 60 connected to the first frame 20 and the second frame 30 by screw. In other embodiments, however, the auxiliary frame 60 is connected by soldering, engaging, or magnet. In the embodiment, the auxiliary frame 60 has at least one reserved hole 601 corresponding to the cable connection hole 501. In other words, the quantity of the reserved hole 601 is the same with the quantity of the cable connection hole 501, and the cable connection hole 501 communicates with the reserved hole 601. In the embodiment shown in FIG. 4A, the foldable patch panel 10 further has a spring unit 602. As shown in FIG. 4B and FIG. 4C, the spring unit 602 includes a T-shape plate 6021 and a U-shape spring member 6022. The T-shape plate 6021 further includes a central hole 60211, and the U-shape spring member 6022 further has a toe 60221. The U-shape spring member 6022 is preferably connected to the lower edge of the wing portion 60212 of the T-shape plate 6021. In other embodiments, however, the U-shape spring member 6022 can connect on any position of the top edge of the T-shape plate 6021. As shown from FIG. 4A to FIG. 4C, the central hole 60211 corresponds to a locking hole 608 of the auxiliary frame 60, so that by means of a screw 609, the spring unit 602 is connected to the auxiliary frame 60 on the first frame 20 or the second frame 30. In the embodiment, the spring unit 602 is preferably made of metal or alloy, so that the auxiliary frame 60 has a ground connection to the first frame 20 or the second frame 30 with the toe 60221. Moreover, the spring unit 602 also provides buffer effect between the first frame 20 or the second frame 30 and the auxiliary frame 60.

Figure 5A:
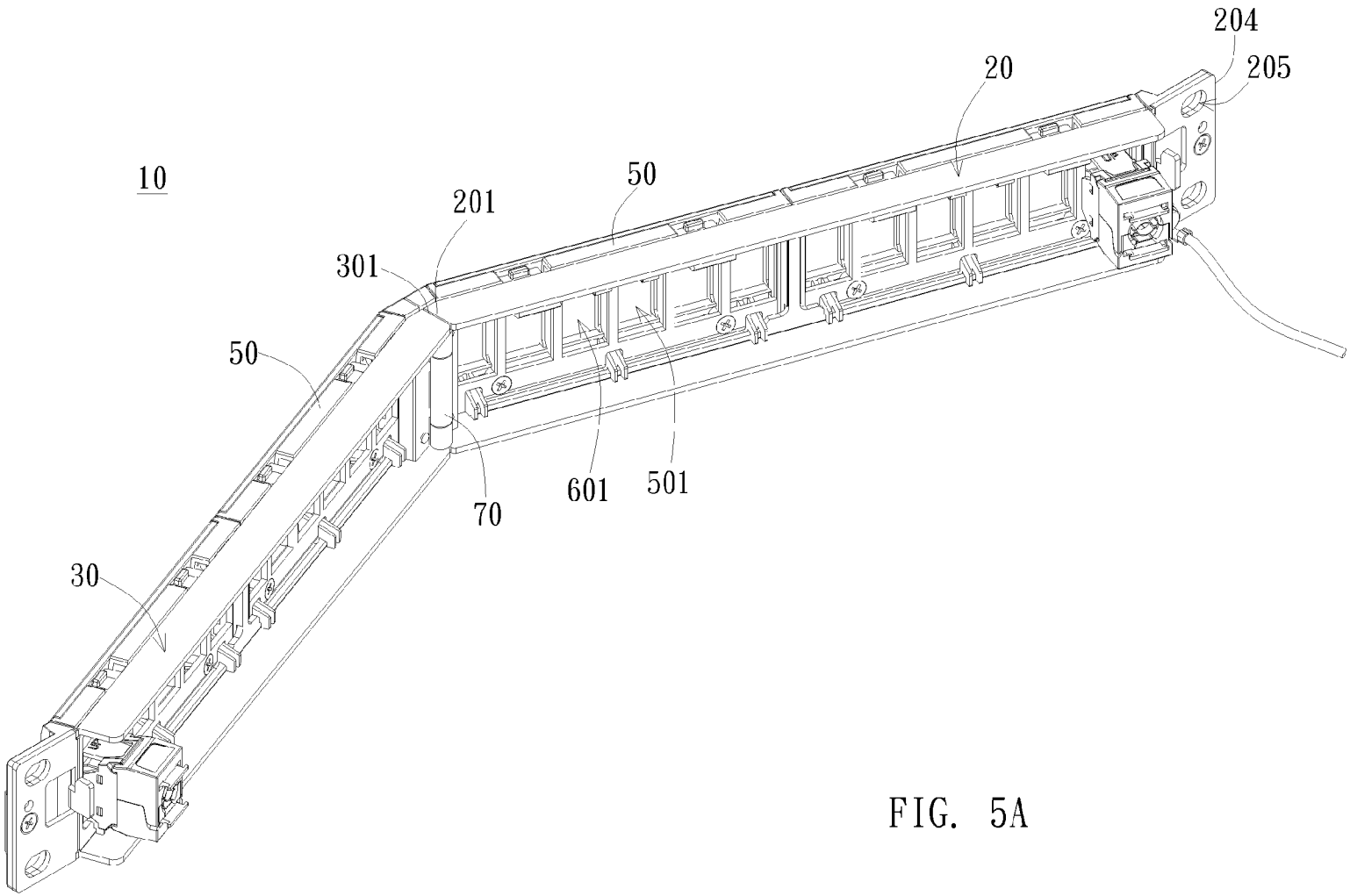
FIG. 5A is a schematic view of another embodiment of the foldable patch panel.

In other embodiments, the connection unit 40 can be replaced by other mechanisms. As shown in FIG. 5A, the foldable patch panel 10 includes the first frame 20, the second frame 30, and a pivot unit 70. The pivot unit 70 connects the first frame 20 and the second frame 30. In the embodiment, the first frame 20 and the second frame 30 rotate with respect to the pivot unit 70, so that the first frame 20 and the second frame 30 can relatively rotate to form an obtuse angle in the open configuration or to be parallel in the folded configuration. In the embodiment shown in FIG. 5A, FIG. 5B, and FIG. 5C, the pivot unit 70 includes a pivot 701, a first wing 702, and a second wing 703, wherein the first wing 702 and the second wing 703 are connected to the pivot 701 on two opposite sides by any suitable mechanism. The first wing 702 and the second wing 703 each has a hole 704. The hole 704 corresponds to a respective locking hole on the first frame 20 and the second frame 30 (not shown). A screw 705 passes through the hole 704 and is fixed to the locking hole. In the embodiment, the second wing 703 connects the central region 7011 of the pivot 701, and the first wing 702 connects the end portion 7012 of the pivot 701, so that the first wing 702 and the second wing 703 can rotate relative to each other.

Figure 5B:
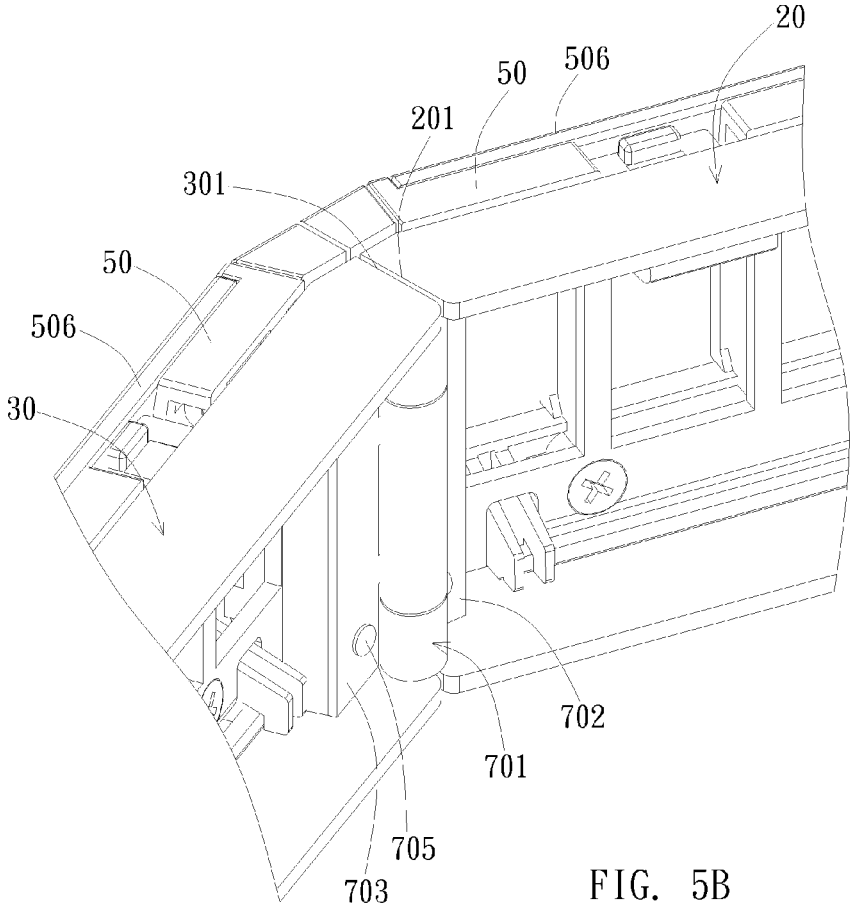
FIG. 5B is a schematic view showing the disposition of the pivot unit.
Figure 5C:
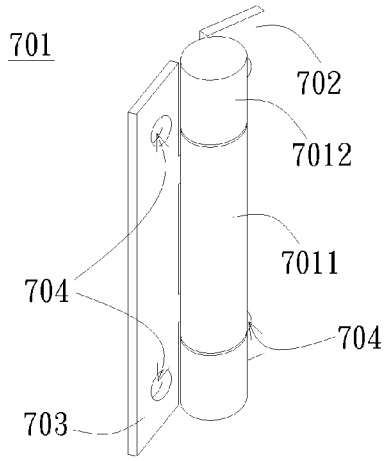
FIG. 5C is a schematic view of the pivot unit.

In the embodiment shown FIG. 5A, FIG. 5B, and FIG. 5C, the first frame 20 includes the engaging end 201 and the connection end 204. The engaging end 201 of the first frame 20 is separably engaged with the second frame 30. The connection end 204 has at least one hole 205. The hole 205 is provided for mounting the foldable patch panel 10 on a rack. As shown in FIG. 5A, FIG. 5B, and FIG. 5C, when the engaging end 301 of the second frame 30 engage with the engaging end 201 of the first frame 20 to form an obtuse angle, the range of the obtuse angle is preferably 90°~180°, more preferably 120°~160°, 110°~140°, or 130°~145°. As shown in FIG. 5A and FIG. 5B, the foldable patch panel 10 includes the casing 50, which is engaged with the first frame 20 and the second frame 30 in a similar manner as described above. The casing 50 includes the cable connection hole 501 and further includes the indication region 506, as described above. As FIG. 5A, FIG. 5B, FIG. 5C, and FIG. 4A show, the foldable patch panel 10 further includes at least one auxiliary frame 60 and the spring unit 602, wherein the spring unit 602 connects the auxiliary frame 60 to the first frame 20/the second frame 30. The auxiliary frame 60 includes at least one reserved hole 601, and the cable connection hole 501 communicates with the reserved hole 601.

Figure 6A:
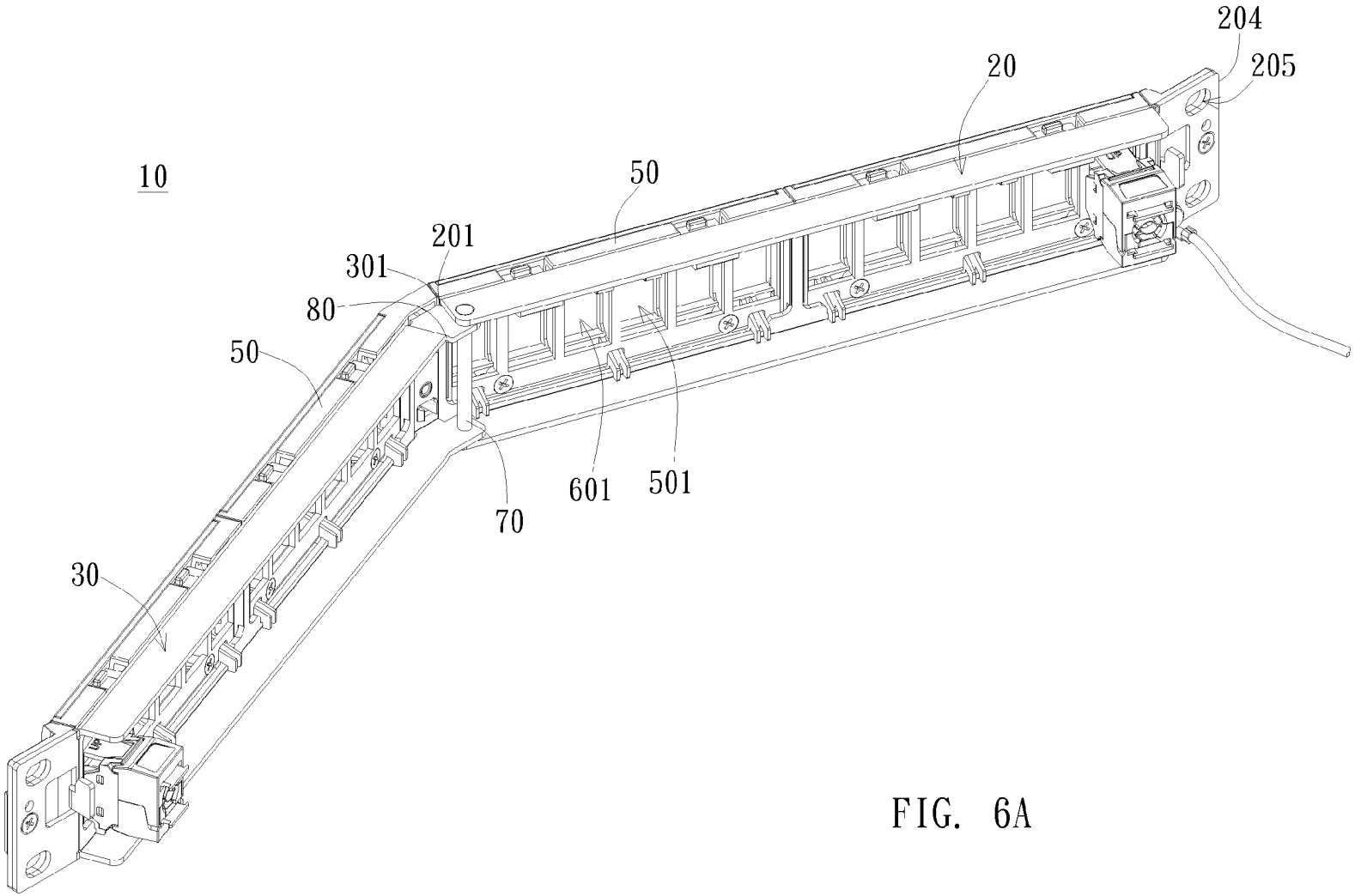
FIG. 6A is a schematic view of further another embodiment of the foldable patch panel.
Figure 6B:
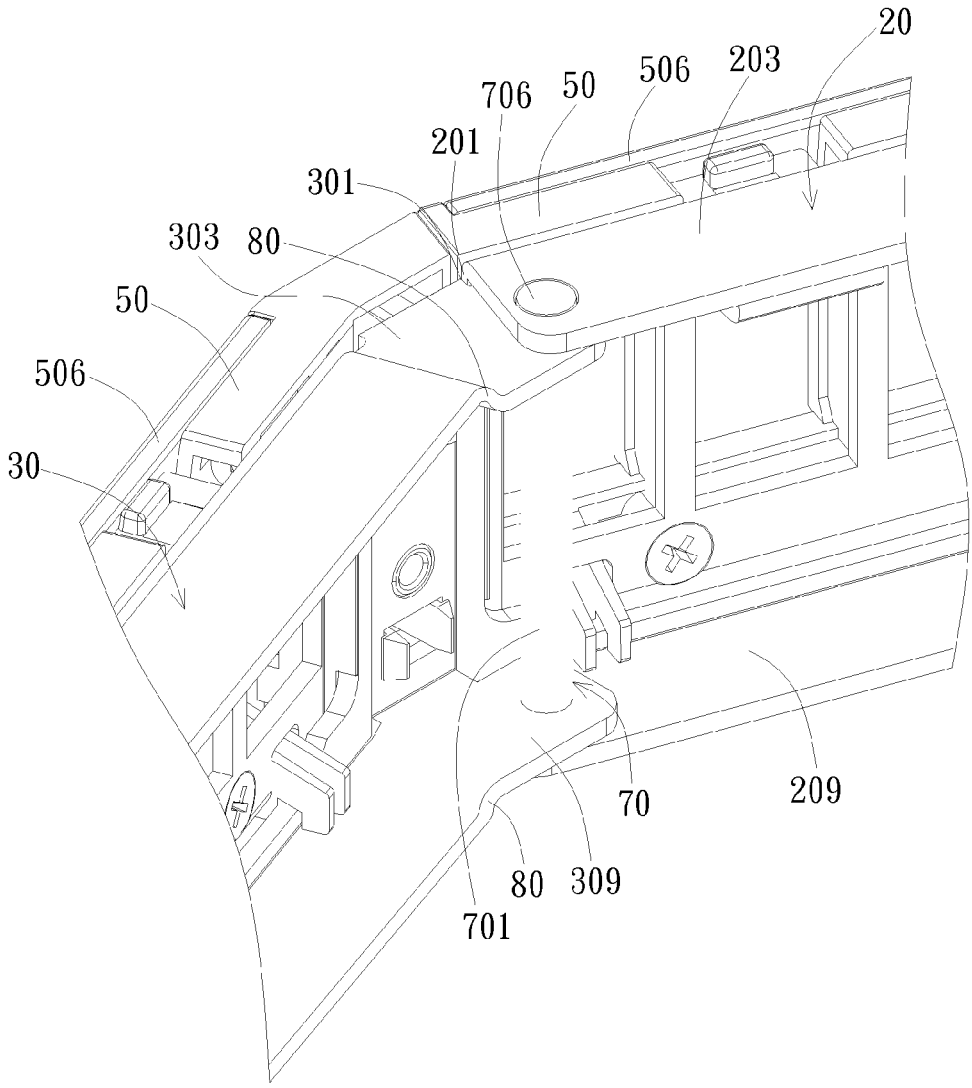
FIG. 6B is a schematic view showing the disposition of the pivot unit.

In the embodiment shown in FIG. 6A and FIG. 6B, the pivot unit 70 can be a pivot without any wings. In the embodiment, the pivot unit 70 includes the pivot 701 and a nut 706. The nut 706 fixes the pivot 701 on the upper plates 203, 303 and the lower plates 209, 309 of the first frame 20 and the second frame 30. In the embodiment as shown in FIG. 6A and FIG. 6B, for engaging the first frame 20 with the second frame 30, the upper plate 303 and the lower plate 309 of the second frame 30 each has a bend portion 80 to allow a part of the engaging end 301 of the second frame 30 to be accommodated between the upper plate 203 and the lower plate 209 of the first frame 20 while the other part of the engaging end 301 is separably engaged with the engaging end 201 of the first frame 20. In the embodiment, gaskets (not shown) are preferably provided between the pivot unit 70 and the first frame 20/the second frame 30 to prevent the pivot unit 70 from wearing because of the friction between the first frame 20 and the second frame 30. In the embodiment shown in FIG. 6A and FIG. 6B, the related descriptions of the casing 50 and the auxiliary frame 60 can be referred to the previous embodiments. In this embodiment, only one pivot unit 70 is required to achieve the foldable feature of the patch panel, so that the manpower of assembly and the fabrication cost can be largely reduced.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A foldable patch panel, comprising:

a first frame;

a pivot unit connected to the first frame;

a second frame connected to the pivot unit, wherein the first frame and the second frame rotate with respect to the pivot unit and are separably engaged with each other, so that the first frame and the second frame form an obtuse angle or are folded to be parallel to each other;

at least one auxiliary frame having at least one reserved hole;

a spring unit connecting the auxiliary frame to the first frame; and a casing engaged with the first frame and having at least one cable connection hole, wherein the cable connection hole communicates with the reserved hole.

2. The foldable patch panel in claim 1, wherein the pivot unit comprises a pivot, a first wing, and a second wing, wherein the first wing and the second wing are connected to two sides of the pivot, respectively, and the first wing is connected to the first frame, so that the pivot serves as a rotation axis of the first frame.

3. The foldable patch panel in claim 1, wherein the pivot unit comprises a pivot penetrating the first frame and the second frame to rotatably connecting the first frame and the second frame.

4. The foldable patch panel in claim 1, wherein the first frame includes an engaging end and a connection end, the engaging end is separably engaged with the second frame, the connection end has at least one hole, and the obtuse angle is between 90° and 180° while an engaging end of the second frame is engaged with the engaging end of the first frame.

5. The foldable patch panel in claim 1, wherein the casing further includes an indication region.

6. A foldable patch panel, comprising:

a first frame including an engaging end and a connection end, wherein the connection end has at least one hole, and the engaging end has a connection hole;

a connection unit including a stopper and a connection ear, wherein the connection ear connects to the stopper, the first frame is rotatably connected to the connection ear by a first pivot, the engaging end is separably engaged with the stopper, the connection hole communicates with an axial hole of the connection ear to accommodate the first pivot; and a second frame rotatably connected to the connection ear by a second pivot, wherein the first frame and the second frame rotate with respect to the first pivot and the second pivot, respectively, to separably engage with the stopper so that the first frame and the second frame form an obtuse angle or are folded to be parallel to each other, and the obtuse angle is between 90° and 180° while an engaging end of the second frame and the engaging end of the first frame are engaged with the stopper.

7. The foldable patch panel in claim 6, further comprising a casing, is engaged with the first frame, wherein the casing further includes an indication region.

8. The foldable patch panel in claim 6, further comprising at least one auxiliary frame, a spring unit, and a casing, wherein the spring unit connects the auxiliary frame to the first frame, the auxiliary frame has at least one reserved hole, the casing is engaged with the first frame and has at least one cable connection hole, the cable connection hole communicates with the reserved hole.

9. The foldable patch panel in claim 6, further comprising at least one auxiliary frame connected to the first frame.

10. A foldable patch panel, comprising:

a first frame;

a connection unit including a stopper and a connection ear, wherein the connection ear connects to the stopper, and the first frame is rotatably connected to the connection ear by a first pivot; and a second frame connected to the connection ear, wherein the first frame rotates with respect to the second frame to separably in contact with the stopper so that the first frame and the second frame are selectively in an open configuration and a folded configuration, wherein in the folded configuration, the first frame and the second frame are folded to be parallel to each other.

11. The foldable patch panel in claim 10, wherein the first frame includes an engaging end and a connection end, the engaging end is separably engaged with the stopper, the connection end has at least one hole, the engaging end has a connection hole communicating with an axial hole of the connection ear to accommodate the first pivot.

12. The foldable patch panel in claim 10, wherein in the open configuration, the first frame and the second frame form an obtuse angle ranging between 90° and 180°.

13. The foldable patch panel in claim 10, wherein in the folded configuration, the first frame and the second frame are parallel to each other.

14. The foldable patch panel in claim 10, wherein the connection unit further comprises an additional connection ear on one end of the stopper opposite to the connection ear, and the first frame is rotatably connected to the additional connection ear by an additional pivot.

15. The foldable patch panel in claim 10, wherein the connection unit further comprises an additional connection ear disposed on the stopper close to the connection ear to form a receiving space for accommodating a plate portion of the first frame and a plate portion of the second frame.

* * * * *